US008517676B2

(12) United States Patent
Pauli et al.

(10) Patent No.: US 8,517,676 B2
(45) Date of Patent: Aug. 27, 2013

(54) WELDED ROTOR OF A GAS TURBINE ENGINE COMPRESSOR

(75) Inventors: Ernst Pauli, Zürich (CH); Thomas Kramer, Ennetbaden (CH); Holger Kiewel, Brugg (CH)

(73) Assignee: Alstom Technology Ltd, Baden (CH)

( * ) Notice: Subject to any disclaimer, the term of this patent is extended or adjusted under 35 U.S.C. 154(b) by 0 days.

(21) Appl. No.: 13/463,090

(22) Filed: May 3, 2012

(65) Prior Publication Data

US 2012/0275926 A1 Nov. 1, 2012

Related U.S. Application Data

(63) Continuation of application No. PCT/EP2010/066501, filed on Oct. 29, 2010.

(30) Foreign Application Priority Data

Nov. 4, 2009 (CH) ..... 1699/09

(51) Int. Cl.
*F04D 29/044* (2006.01)
*B21K 25/00* (2006.01)

(52) U.S. Cl.
USPC ..... 415/199.5; 416/213 R; 29/889.2; 29/889.21

(58) Field of Classification Search
USPC ..... 415/199.5, 200, 216.1; 416/213 R, 416/244 A; 29/527.2, 889.2, 889.21
See application file for complete search history.

(56) References Cited

U.S. PATENT DOCUMENTS

| | | | | |
|---|---|---|---|---|
| 2,462,600 A | | 2/1949 | Boestad et al. | |
| 2,657,008 A | | 10/1953 | Atkinson | |
| 4,645,553 A | | 2/1987 | Languillat | |
| 5,414,929 A | * | 5/1995 | Floser et al. | 29/889.21 |
| 5,507,620 A | | 4/1996 | Primoschitz et al. | |
| 5,993,154 A | | 11/1999 | Endres et al. | |
| 6,152,697 A | * | 11/2000 | Konishi et al. | 416/213 R |
| 6,224,328 B1 | | 5/2001 | Weigand et al. | |
| 6,753,504 B2 | | 6/2004 | Keller et al. | |
| 2004/0189108 A1 | | 9/2004 | Dooley | |
| 2008/0211339 A1 | * | 9/2008 | Rotzinger et al. | 310/216 |

FOREIGN PATENT DOCUMENTS

| | | | |
|---|---|---|---|
| DE | 879343C | B1 | 6/1953 |
| DE | 4324034 | A1 | 1/1995 |
| DE | 10112062 | A1 | 9/2002 |
| EP | 0844367 | A1 | 5/1998 |
| EP | 0844367 | B1 | 5/1998 |
| EP | 0984138 | B1 | 10/2005 |
| EP | 1705339 | A2 | 9/2006 |
| EP | 1936115 | A2 | 6/2008 |

* cited by examiner

*Primary Examiner* — Edward Look
*Assistant Examiner* — Jason Davis
(74) *Attorney, Agent, or Firm* — Volpe and Koenig, P.C.

(57) ABSTRACT

A rotor (1) of a gas turbine compressor comprises a multiplicity of welded-together rotor disks (3*a*, 3*b*, 4, 5), of which two or more rotor disks (3*a*, 3*b*), in a radially outer region (9'), are welded together, and, in a radially inner central region (9), are abutment-joined together. Via the abutment-joining of two rotor disks (3*a*, 3*b*), a heat flow (8) radially outward from the center of the rotor (1) is achieved so that the material temperature of the rotor (1) can be kept below a predetermined level during operation. As a result, the service life of the rotor (1) can be increased. In one embodiment, one rotor disk (3*a*), on its surface, additionally has a recess (7) which can be cooled from outside. The rotor disks (3*a*, 3*b*) according to the invention, which are welded and abutment-joined together, can especially be used at the last point in the flow direction of the compressor.

8 Claims, 4 Drawing Sheets

WELDED ROTOR OF A GAS TURBINE ENGINE COMPRESSOR

RELATED APPLICATIONS

The present application is a Continuation of PCT Application No. PCT/EP2010/066501, filed Oct. 29, 2010, which claims priority to Swiss Patent application number 01699/09, filed Nov. 4, 2009, the entire contents of which are hereby incorporated by reference.

TECHNICAL FIELD

The present invention refers to welded rotors for gas turbine compressors, and also to a method for their production.

BACKGROUND OF THE INVENTION

Rotors for gas turbines usually comprise a plurality of disks which are either joined together by means of bolted connections or are welded together. In order to avoid overheating during operation and consequently to avoid reduction of the service life of the rotors which is brought about, the rotors are actively cooled. In this case, there is a difference between cooling methods for rotors which are connected by bolts and for welded rotors. The cooling methods for bolted rotors can be used in the case of welded rotors only to a limited extent because the rotor disks in the case of welded rotors are more solid in comparison to bolted rotors and internal cooling via holes would be more difficult to realize.

For welded rotors, various cooling devices with cooling passages and cooling chambers inside and outside the rotor are known.

For example, EP984138 discloses a rotor for a gas turbine, especially for a compressor, the surface of which is impinged upon by cooling streams. The cooling streams are guided via air passages through the stator blades and through openings in their blade tips directly to the rotor surface.

EP844367 discloses a welded rotor for a turbomachine with a plurality of rotor disks which have an annular cavity in each case between weld seams for the purpose of throughflow of cooling steam. The cooling medium is guided through the rotor itself radially outward to the blade roots.

EP1705339 discloses a rotor for a gas turbine with radially extending cooling air passages, these having an elliptical cross section.

In the case of rotors for gas turbines, especially the last rotor disks in the compressor, in the flow direction of the air to be compressed, are subjected to high operating temperatures on account of the compression of air. The temperature steadily increases the temperature over the length of the compressor in the process, the heat penetrating radially into the rotor. In the last rotor disks which are referred to active cooling is necessary in order to keep the material temperature below a certain level and to achieve a correspondingly anticipated service life of the rotor.

A known technique for cooling the last rotor disk of a compressor is shown in FIG. 1.

A rotor 1 for a gas turbine with a rotor axis 2 has a plurality of rotor disks 3, 4 and 5 which are interconnected by means of weld seams 6 between internal cavities H and H'—which are formed as a result of the axial joining together of the disks—and the rotor surface. The last rotor disk 3, moreover, has a recess 7 on its surface. Cooling air from outside the rotor is fed to this recess. Heat from the middle region of the last disk 3 of the compressor rotor is extracted in the direction of the arrow 8 and finally via the cooling recess. The heat discharge

8 is consequently beneficial in this case if the rotor disk is solidly designed in the axial direction. Limits are set upon a solid design in the axial direction, however, on account of the manufacturing engineering of such rotors and also on account of the necessity of being able to test these during the forging process.

EP19316115 discloses a rotor, comprising welded disks, for a steam turbine. The rotor disks have in each case recesses which extend radially outward from their center on the rotor axis so that after the welding together of the disks a cavity is formed on and around the rotor axis. The rotor is cooled on the rotor surface by means of a supplied steam flow.

SUMMARY OF THE INVENTION

The present invention is based upon the object of providing a rotor, which is welded from a multiplicity of rotor disks, for a gas turbine compressor, in which the material temperature of the compressor rotor disks can be kept to, or below, a predetermined level during operation so that a predetermined service life can be anticipated. At the same time, the rotor, in comparison to rotors of the prior art, is to be improved with regard to its production and to possibilities for its testing during the forging process. Moreover, it is an object of the invention to propose a method for producing such a rotor.

A coolable welded gas turbine compressor rotor, with a multiplicity of rotor disks which are arranged axially next to each other and welded together, is featured, wherein each rotor disk extends over at least three blade stages. According to the invention, the rotor, in addition to the welded-together rotor disks, has two or more rotor disks which in a central region, around and on the rotational axis of the rotor disks, are abutment-joined together, wherein the central region encompasses the rotor axis and extends radially outward from the axis. Moreover, the last two rotor disks in the flow direction are welded together in a radially outer region, wherein this radially outer region is radially outside the central region, encompasses the rotor surface, and extends radially inward from the surface. An annulus extends between the central region with the abutment joint and the welded, radially outer region. For the discharge of heat from the central region of the rotor disk to the surface, the rotor disk which is last in the flow direction and abutment-joined to the second from last rotor disk has a recess on its radially outer surface which extends over the periphery of the rotor disk and can be cooled by means of an externally supplied cooling medium.

The recess is expediently applied to the last rotor disk which is subjected to the highest temperatures. The coolable recess together with the abutment joint of the rotor disks in the central region particularly ensures an increased heat discharge from the middle region of the rotor towards the rotor surface.

The invention is particularly advantageous in the case of the last rotor disk of a compressor or in the case of rotor disks which are subjected to higher temperatures.

The rotor, in the region of the highest temperatures, has two or more rotor disks which in comparison to the rotor disks of the prior art are of a smaller, i.e. less thick, design. However, they extend over at least three blade stages. On account of their smaller size, these are simpler to produce. In particular, their forgeability is improved and the achievable degree of deformation is increased.

Moreover, the individual rotor disks are simpler to test during the forging process, since because of the smaller thickness of the disks the path length of sound waves during testing is shortened and consequently measuring results with higher resolution can be achieved.

The abutment joint over the radially inner central region of the last two rotor disks in the flow direction can bring about a heat flow from the central region of the rotor to the radially outer surface of the rotor, where it can be discharged via the recess. As a result, the problem of excessive heating of the rotor at the last point of the rotor in the flow direction, which occurs particularly in the case of gas turbine compressors, is solved. The material temperature of the rotor during operation can consequently be kept below a predetermined level and therefore the service life of the rotor can be increased. The construction of the coolable rotor according to the invention is most effective at the last point of the rotor which is also subjected to the highest temperatures.

The rotor disks according to the invention can also be arranged at any expedient point of the rotor at which cooling, on account of the temperature conditions, is virtually necessary or effective.

In a further embodiment of the invention, the rotor additionally has a coating with a heat-conducting material between the abutment-joined rotor disks in the central region of the disks. For example, this coating is applied to the surface of one of the two rotor disks. A metal with higher thermal conductivity than that of the rotor, for example steel, is suitable for the heat-conducting material.

By using a heat-conducting constituent, the heat flow from the middle of the rotor disk, that is to say from the region around the rotational axis and from the first to the second abutment-joined rotor disks, to the outer surface of the rotor is of further benefit and the anticipated service life of the rotor is further increased.

None of the featured embodiments of the rotor according to the invention are limited only to two rotor disks but can be suitably applied to a plurality of rotor disks of the rotor.

In a method for producing a coolable gas turbine compressor rotor, a multiplicity of rotor disks are welded together. According to the invention, provision is made for at least two rotor disks which have in each case an annular recess which extends around the rotational axis of the disks so that an annulus is created between the rotor disks when the rotor disks are arranged axially next to each other. The rotor disks are arranged at the last and second from last points of the rotor in the flow direction, and in a radially outer region, which extends from the annulus radially outward to the outer surface of the disks, are welded together, and in a radial central region, which extends from the middle of the rotor disk or from the rotational axis of the disks radially outward to the annulus, are abutment-joined together. Moreover, on the rotor disk which is arranged at the last point in the flow direction, a coolable recess is applied, extending over the periphery of the rotor disk.

For this purpose, in one embodiment of the method the two rotor disks are welded together in the radially outer region and then drawn together by means of weld shrinkage.

As a result of the weld shrinkage, a residual compressive stress is created, enabling an increased service life of the rotor.

In one embodiment, the abutment-joined rotor disks are arranged at the point of the highest anticipated material temperatures of the rotor.

In a further embodiment of the method, a coating of a heat-conducting material is applied in the central region of at least one of the last two rotor disks in the flow direction. After this, the two rotor disks are welded together in their radially outer region. In the central region around the rotational axis of the disk, they are again abutment-joined to each other.

The same designations in the various figures stand for the same components in each case.

EMBODIMENTS OF THE INVENTION

Figure 1:
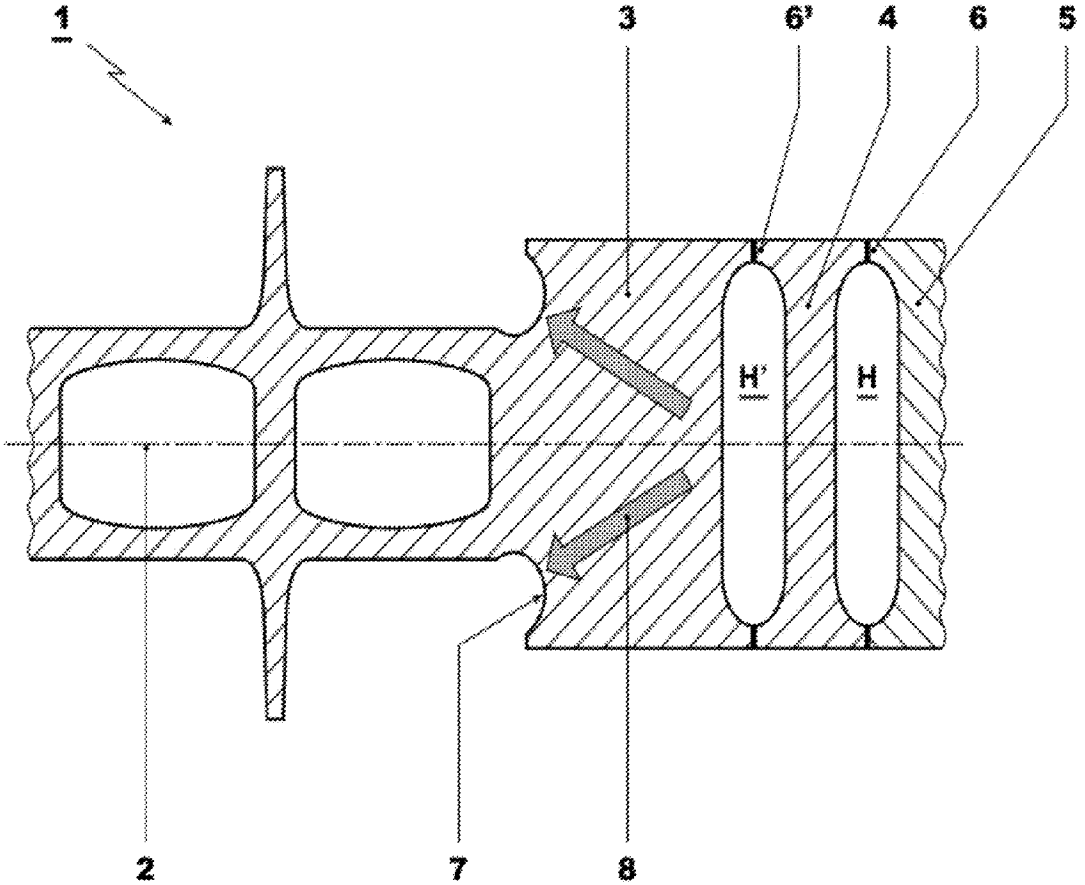
FIG. 1 (Prior Art)
FIG. 1 shows in cross section a welded gas turbine compressor rotor of the prior art.
Figure 2:
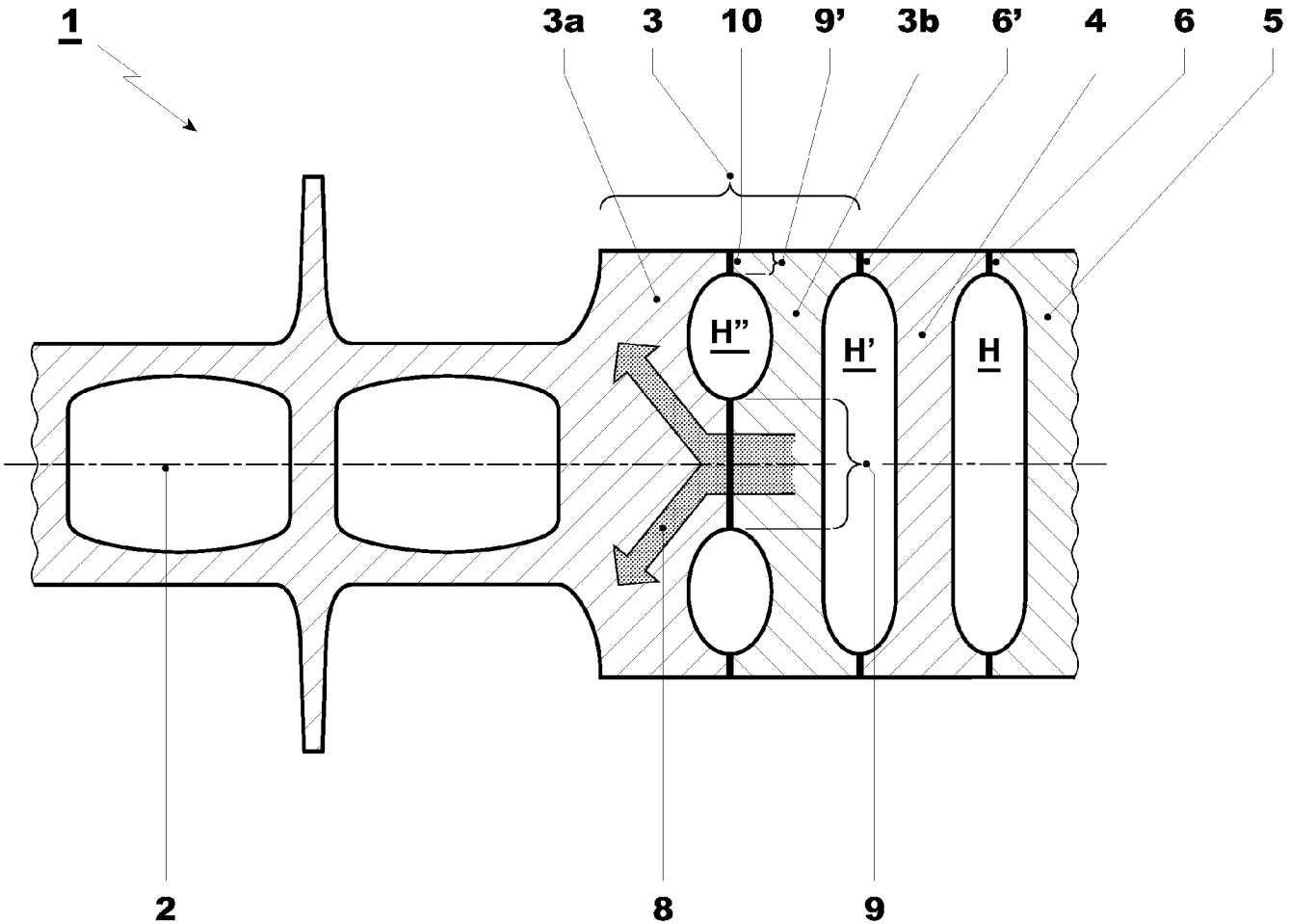
FIG. 2 shows in cross section a first embodiment of a part of a welded gas turbine compressor rotor, particularly of the rotor disks according to the invention.

FIG. 2 shows in longitudinal cross section a gas turbine compressor rotor 1 with a rotor axis 2. The rotor 1 comprises a multiplicity of rotor disks, of which only rotor disks 3, 4 and 5 are shown in the figure. The rotor disks are constructed in each case so that they can accommodate at least three blade stages of the compressor. As a result, they differ from rotor disks of a rotor of a so-called "laminar" design which extend over only one blade stage. In their middle, rotor disks 4 and 5 have a recess in each case which together form a cavity H after the joining together of the disks. The rotor disks 4 and 5 are interconnected by means of a weld seam 6 between the cavity H and the radially outer surface of the disks 4 and 5. The rotor disk 3 of the rotor of the prior art is realized according to the invention by two individual rotor disks 3*a* and 3*b* which in comparison are less solidly formed. In the depicted example, the rotor disks 3*a* and 3*b* are the rotor disks of a compressor which are arranged at the last and second from last points in the flow direction. In their central region, on their axially facing sides, these rotor disks have a recess in each case, which form an annulus H" after being joined together. The rotor disk 3*b* is joined to the adjacent rotor disk 4 by means of a weld seam 6' in the same way as the rotor disks 4 and 5. On the upstream side, the rotor disk 3*b* also has a recess which, after the joining of the disks 3*b* and 4, forms the cavity H' which is similar to the cavity H.

The rotor disks 3*a* and 3*b* are interconnected in a radially outer region 9' by means of the weld seam 10 which extends from the annulus H" to the surface of the rotor. In a central region 9 around the rotational axis 2 of the rotor disks 3*a* and 3*b*, the facing surfaces of the disks are abutment-joined together.

The central region 9 of the rotor is, for example, the region which encompasses the rotational axis and extends around the rotational axis of the disks and over the radially inner region, and which is encompassed by the annular recess on the facing sides of the rotor disks 3*a* and 3*b*. Heat is also to be discharged from this central region in order to avoid overheating of the rotor. After the joining together of the rotor disks 3*a* and 3*b*, the annular recesses of the disks form the annulus H". The radially outer region 9' extends, for example, between the inner recesses of the disks or the annulus H" and the rotor surface. The abutment joint ensures a heat flow 8 from the central region 9 of the rotor disk 3*b* via the rotor disk 3*a* and radially outward to the rotor surface, where the heat can be discharged.

Figure 3:
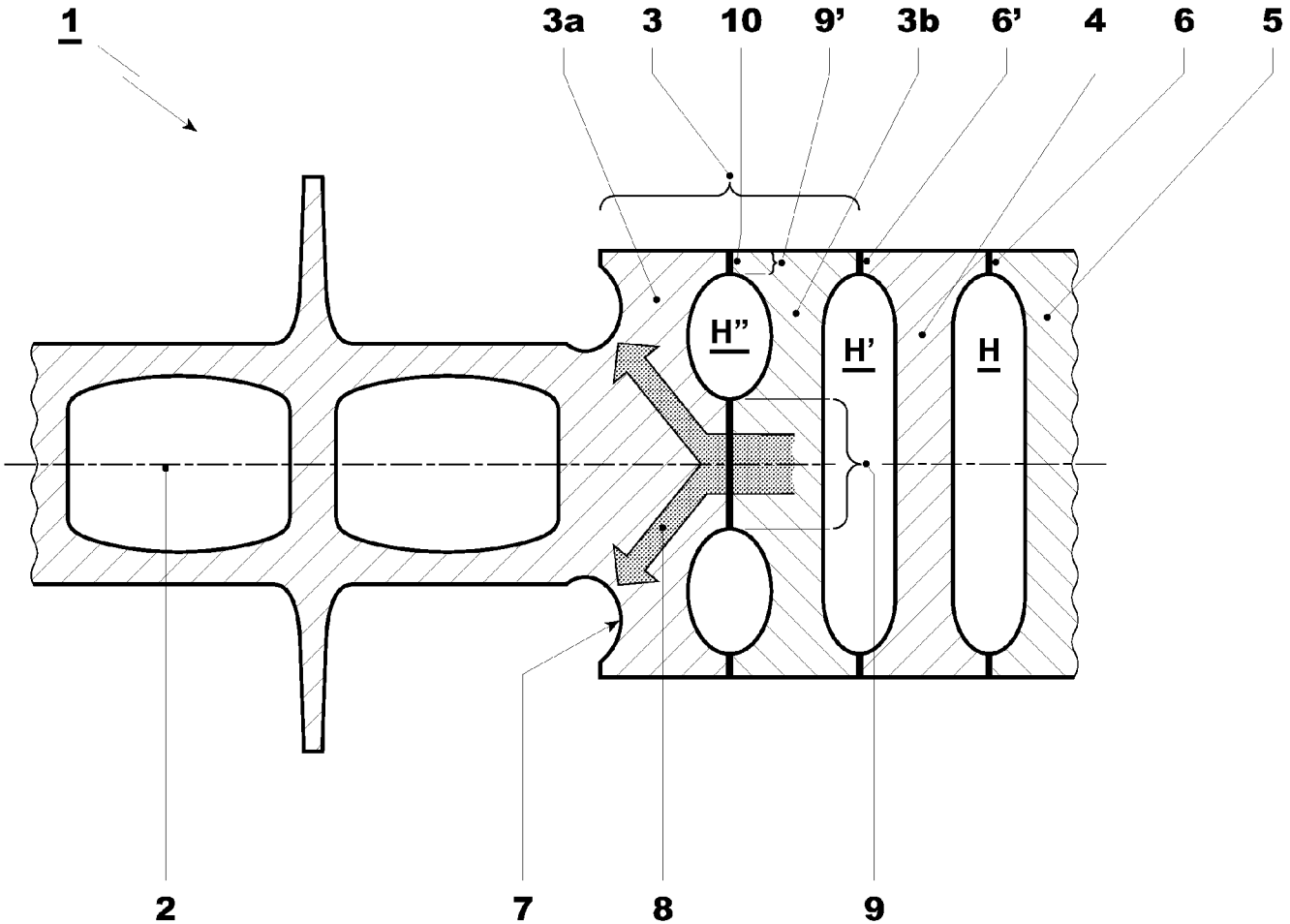
FIG. 3 shows in cross section a second embodiment of a part of a welded gas turbine compressor rotor according to the invention.

FIG. 3 shows the same rotor as in FIG. 2, but with the additional feature on the rotor disk 3*a* which is arranged on the rotor at the last point in the flow direction. On its surface, the rotor disk 3*a* has a recess 7 or annular groove which extends over the periphery of the rotor disk and can be cooled from outside by means of a suitable cooling medium, such as cooling air or cooling steam. The heat, which is directed from the central region 9 of the rotor disks 3*a* and 3*b* to the surface, is discharged with increased effectiveness via the recess 7.

In an especially effective embodiment of the invention, the recess 7 of the rotor disk 3*a* is constructed with an elliptical cross-sectional contour.

Figure 4:
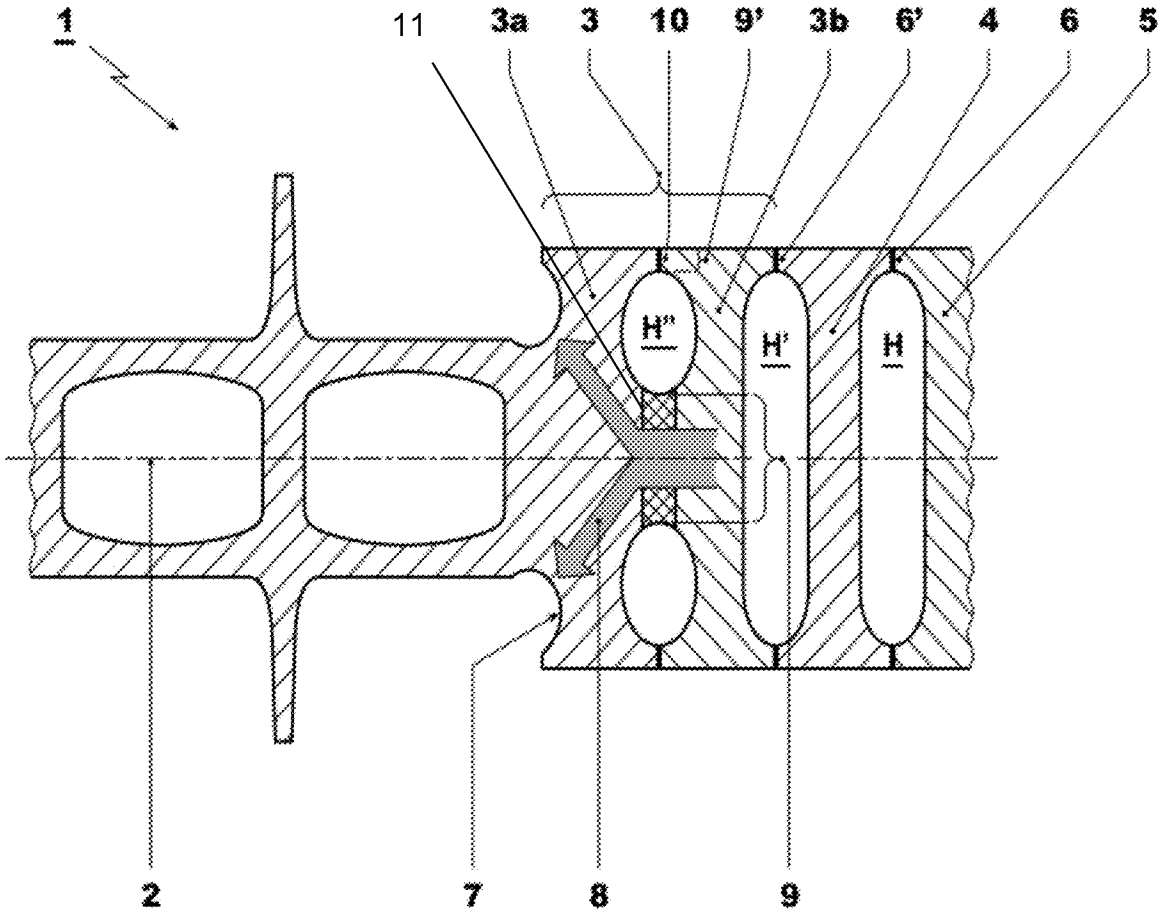
FIG. 4 shows in cross section a third embodiment of a part of a welded gas turbine compressor rotor, particularly of the rotor disks according to the invention.

FIG. 4 shows an enhanced embodiment of the rotor 1 according to the invention, again comprising rotor disks 3*a*, 3*b*, 4, 5. The rotor disks 3*a* and 3*b*, on their axially facing sides, again have an annular recess in each case which, after the joining together of the disks 3*a*, 3*b*, form an annulus H". A central region 9 on the facing surfaces of the rotor disks 3*a*, 3*b* extends over the region which is encompassed by the annulus H". The enhanced embodiment differs from the rotor from FIGS. 2 and 3 in the realization of the heat transfer in the central region 9 of the rotor disks 3*a* and 3*b*. The rotor disk 3*a* or 3*b* in its central region 9 has a coating 11 of a heat-conducting material. This coating 11 and the surface of the central region 9 of the rotor disk 3*b* are again abutment-joined together.

The coating 11, for example, comprises a suitable metal with a thermal conductivity which is greater than that of the rotor material.

LIST OF DESIGNATIONS

1 Rotor
2 Rotor axis
4, 5 Rotor disks, welded
3 Last rotor disk
3*a*, 3*b* Rotor disks, abutment-joined together and welded
6, 6' Weld seam
7 Recess
8 Heat flow
9 Central region
9' Radially outer region
10 Weld seam
11 Heat-conducting coating
H, H' Cavity
H" Annulus

The invention claimed is:

1. A coolable gas turbine compressor rotor (1) comprising a multiplicity of welded-together rotor disks (3*a*, 3*b*, 4, 5), wherein each rotor disk (3*a*, 3*b*, 4, 5) extends over at least three blade stages and of which at least two rotor disks (3*a*, 3*b*) are arranged axially next to each other and at a last and second from last point of the rotor (1) in a flow direction, the rotor disks (3*a*, 3*b*) have a central region (9) which encompasses the rotational axis (2) of the rotor (1) and extends radially outward from the rotational axis (2), and the rotor disks (3*a*, 3*b*) have a radially outer region (9') which encompasses the radially outer surface of the rotor and extends radially inward, and for discharging heat from a central region (9) of the last two rotor disks (3*a*, 3*b*) in the flow direction, the last two rotor disks (3*a*, 3*b*) in the flow direction are abutment-joined together in their central region (9) and are welded together in a radially outer region (9') of the rotor disks (3*a*, 3*b*) and an annulus (H") extends between the central region (9) and the radially outer region (9') of the last two rotor disks (3*a*, 3*b*) in the flow direction, and the last of the two abutment-joined rotor disks (3*a*, 3*b*) in the flow direction has on a radially outer surface a recess (7) which can be cooled by means of an externally supplied cooling medium and which extends over a periphery of the rotor disk.

2. The rotor (1) as claimed in claim 1, wherein a coating (11) with a heat-conducting material is arranged between the abutment-joined rotor disks (3*a*, 3*b*) in their central region (9).

3. The rotor (1) as claimed in claim 2, wherein the coating (11) is applied to a surface of one of the abutment-joined rotor disks (3*a*, 3*b*).

4. The rotor (1) as claimed in claim 2, wherein the recess (7) has an elliptical cross-sectional contour.

5. The rotor (1) as claimed in claim 1, wherein the abutment-joined rotor disks (3*a*, 3*b*) are arranged at a point on the rotor with one of the highest material temperatures in the entire rotor.

6. A method for producing a gas turbine compressor rotor (1), wherein a multiplicity of rotor disks (4, 5) are welded together and extend over at least three blade stages of the compressor, wherein provision is made for at least two rotor disks (3*a*, 3*b*) which have an annular recess in each case which extends around the rotational axis of the disks and the rotor disks are arranged axially next to each other so that an annulus is created between the rotor disks, and the rotor disks (3*a*, 3*b*) are arranged at the last and second from last points of the rotor (1) in a flow direction and in a radially outer region (9'), which extends from the annulus (H") radially outward to an outer surface of the disks (3*a*, 3*b*), are welded together and in a radial central region (9), which extends from a middle of the rotor disks or from a rotational axis (2) of the disks (3*a*, 3*b*) radially outward to the annulus (H"), are abutment-joined together, and a recess (7) is realized on the outer surface of a rotor disk (3*a*) which is arranged at the last point in the flow direction, said method comprising arranging said disks next to each other to create said annulus between the rotor disks and welding said disks together.

7. The method as claimed in claim 6, wherein the abutment-joined rotor disks (3*a*, 3*b*) are drawn together by means of weld shrinkage.

8. The method as claimed in claim 6, wherein before the abutment-joining and welding of the rotor disks (3*a*, 3*b*) a coating (11) with a heat-conducting material is arranged in the central region (9) around the rotational axis of the rotor disks (3*a*, 3*b*) between said rotor disks (3*a*, 3*b*).

* * * * *